US006209888B1

(12) United States Patent
Bozinovic

(10) Patent No.: US 6,209,888 B1
(45) Date of Patent: Apr. 3, 2001

(54) INLINE SKATES WITH TWO BRAKES USED SIMULTANEOUSLY

(76) Inventor: Zoran Bozinovic, Kraljia Milutina 1/2, 11000 Beograd (YU)

( * ) Notice: Subject to any disclaimer, the term of this patent is extended or adjusted under 35 U.S.C. 154(b) by 0 days.

(21) Appl. No.: 09/403,964

(22) PCT Filed: Apr. 8, 1998

(86) PCT No.: PCT/YU98/00012

§ 371 Date: Nov. 1, 1999

§ 102(e) Date: Nov. 1, 1999

(87) PCT Pub. No.: WO98/50119

PCT Pub. Date: Nov. 12, 1998

(30) Foreign Application Priority Data

May 8, 1997 (YU) ..... 177/97

(51) Int. Cl.[7] ..... A63C 17/14

(52) U.S. Cl. ..... 280/11.206; 188/5; 280/11.215; 280/11.231

(58) Field of Search ..... 280/11.221, 11.204, 280/11.206, 11.211, 11.215, 11.216, 11.217, 11.231; 188/4 R, 4 B, 5

(56) References Cited

U.S. PATENT DOCUMENTS 333,751 * 1/1886 Harris, Jr. ..... 280/11.217
3,224,785 * 12/1965 Stevenson ..... 280/11.206
4,453,726 * 6/1984 Ziegler ..... 280/11.206
5,088,748 * 2/1992 Koselka et al. ..... 280/11.206
5,183,275 2/1993 Hoskin .
5,232,231 8/1993 Carlsmith .
5,280,931 * 1/1994 Horton ..... 280/11.2
5,375,859 12/1994 Peck et al. .
5,401,038 * 3/1995 Peck et al. ..... 280/11.206
5,413,362 * 5/1995 De Santis ..... 280/11.206
5,501,474 * 3/1996 Conte ..... 280/11.215
5,791,663 * 8/1998 Klukos ..... 280/11.206

* cited by examiner

*Primary Examiner*—Michael Mar
(74) *Attorney, Agent, or Firm*—Patterson, Thuente, Skaar & Christensen, P.A.

(57) ABSTRACT

Inline skates with a braking system allowing the brakes to be used simultaneously. One embodiment of the invention comprises a frame 1 with a rear wheel carrier and a braking wheel carrier 6 rotatingly mounted on frame 1 through a first cylinder 29 and an axle 11 and interlocking through a notch 8 on a braking wheel carrier 6 and a fourth cylinder 9 on a first rear wheel carrier 7 while first rear wheel 4 and a braking wheel 5 are rotatingly mounted on their respective carriers 7, 6. Another mobile rear wheel 26 is handled by its carrier 30 rotatingly mounted on second cylinder 28 affixed to a frame 1. Breaking force is regulated through a screw 23 and a pair of friction cylinders 16. Carrier rotation limiting cylinders 10,17,31 are affixed to a frame 1. The front wheels 2, 3 are standard fixed wheels rotatingly mounted on a frame 1.

1 Claim, 2 Drawing Sheets

INLINE SKATES WITH TWO BRAKES USED SIMULTANEOUSLY

BACKGROUND OF THE INVENTION

This invention relates to a special kind of inline skates featuring extra efficient braking system. Such skates are a sports requsite. As far as is known the inline skates with similar characteristics have never been invented or made.

The object of this invention is to create a braking system for inline skates which makes it possible for two brakes to be used simultaneously. This invention is sharply contrasted to a single brake braking system with all its variations (see document U.S. Pat. No. 5,183,275) widely practiced today which is highly ineffective. Namely, it allows the skater to use one brake only ( during braking action) which causes the problem of balance. To solve the problem of balance, the skate mast use a brake up to 30–40% of its actual braking power.

By contrast our braking system by putting to work two brakes ( at the same time) eliminates the problem of balance and allows both brakes to be used up to 100% of their braking potential from the very beginning of the braking action.

SUMMARY OF THE INVENTION

The main characteristic of inline skates with two brakes to be used simultaneously according to the invention is that they allow the skater to use both brakes at the same time during braking action. This kind of performance is achieved by the specific construction of the frame, the main feature of which is the introduction of the mobile rear wheel working closely with the mobile braking wheel during braking action. The said wheels are made mobile throurgh their respective rotating carriers. A pair of rear wheel carriers rotate around cylinders incorporated in the frame while a pair of braking wheel carriers rotate around the ends of the same axle. The carriers of both said wheels are interlocked during skating through the notch ( on the end ) of braking wheel carrier clutching ( hooking ) the cylinder affixed to the rear wheel carrier. Once the braking action is over, both carriers are pushed back by their respective springs into their starting position to be interlocked eventually.

DESCRIPTION OF THE PREFERRED EMBODIMENT

Figure 1:
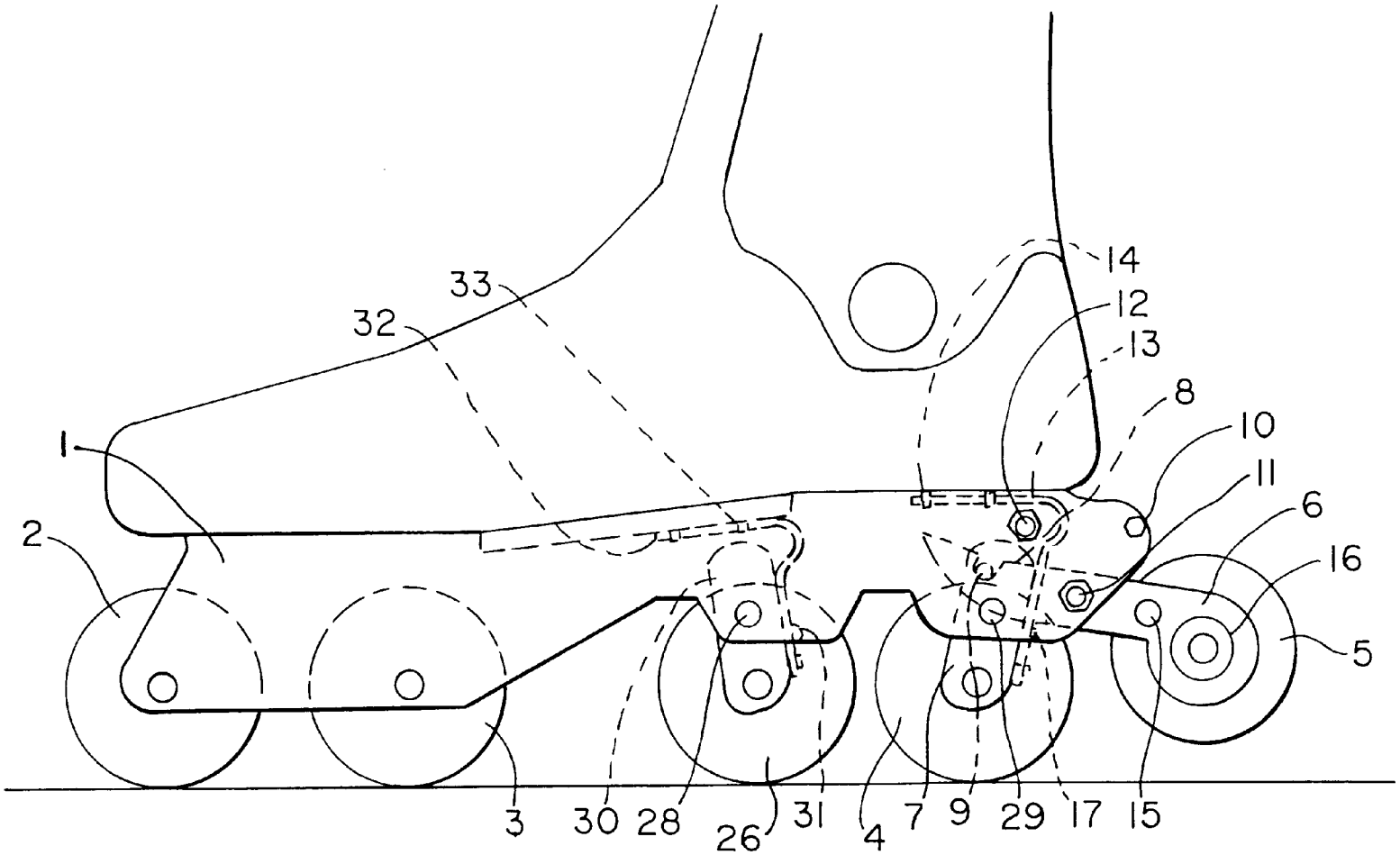
FIG. 1 Is a side view of the skate during skating

FIG. 1 Shows an inline skate with frame 1 affixed to the boot. First two front wheels 2, 3 positioned inline on the frame 1 are standard non fixed mobile wheels. They are followed by two rear (inline) mobile wheels 26, 4. A rear wheel 4 and a braking wheel 5 make up the braking system to be explained in detail.

Figure 3:
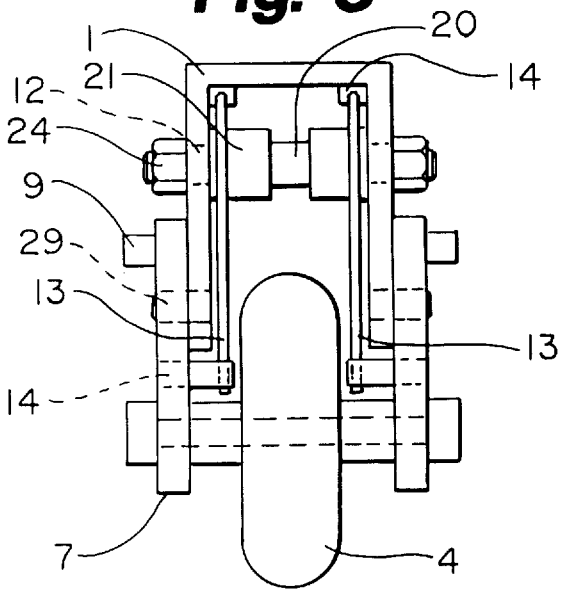

A first rear wheel carrier 7 is rotatingly mounted on a first cylinder 29 affixed to a frame 1 (FIGS. 1,3). The first spring holders 14 are affixed to the inside of the frame 1 and to a first rear wheel carrier 7 holding a pair of first springs 13 the purpose of which is to push back a first rear wheel carrier 7 (once braking is completed) to their starting position ( FIG. 1), till they touch a sixth cylinder 17 affixed to a frame 1 which limits their backward rotation. An axle 12 is affixed to a frame 1 through a pair of screws 24, and has fixedly mounted hallow cylinder 21 on with its mid section 20 (FIG. 3 ) ( notch ) against which one end of a pair of third springs 19 rests. A notch 8 on one end of a braking wheel carrier 6 clutches a fourth cylinder 9 affixed to a first rear wheel carrier 7, to keep a rear wheel 4 firmly in its working position during skating. On the rear end of the frame 1 there is a braking wheel carrier 6 rotatingly mounted on end of an axle 11 which is fixedly mounted on a frame 1 through a pair of screws 25.

Figure 2:
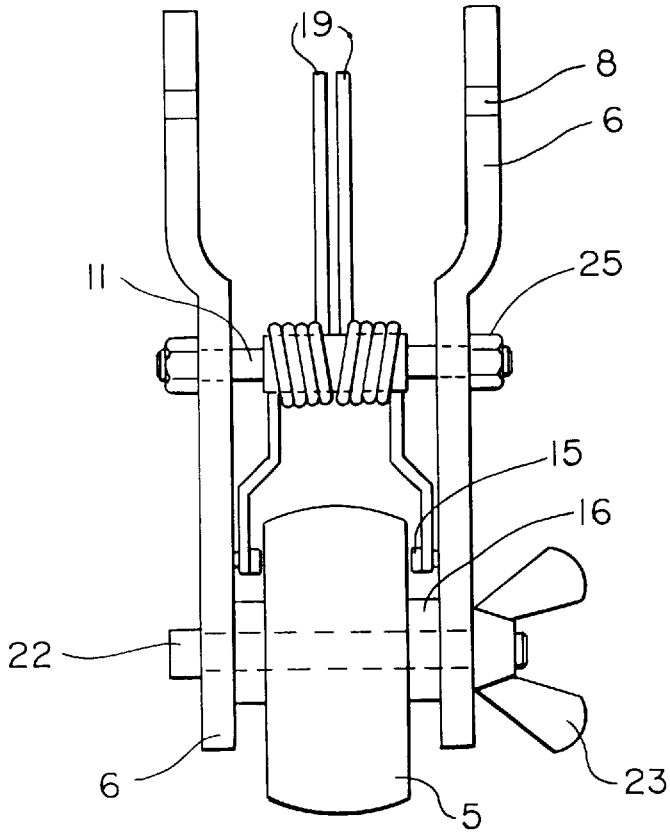
FIG. 2 Is a view from above of the braking wheel, and a pair of its carriers FIG. 3 Is a view from behind of the rear wheel with a pair of its carriers

A pair of third springs 19 (FIG. 2) is mounted on an axle 11, resting with one end against a notch 20 of a hollow cylinder 21 and with other end against third spring holders 15 affixed to a braking wheel carrier 6. By pushing a braking wheel 5 to the ground (mounted on one end of a braking wheel carrier 6) a pair of third springs 19 help a first rear wheel carrier 7 and a braking wheel carrier 6 interlock once braking action is completed. A braking wheel 5 is rotatingly mounted on an axle 22 and constantly pinched with a pair of rubber cylinders through a screw 23 which regulates a braking force of each brake. A first rear wheel carrier 7 and a braking wheel carrier 6 are interlocked during skating (FIG. 1) through a notch 8 ( on a braking wheel carrier 6 ) clutching a fourth cylinder 9 affixed to a first rear wheel carrier 7.

A third inline wheel 26 is mobile and is rotatingly mounted between a pair of its carriers 30 also rotatingly mounted on a second cylinder 28 affixed to a frame 1. During skating a second rear wheel carrier 30 rests against a pair of seventh cylinders 31 affixed to a frame 1 due to an angle between the ground and a second rear wheel carrier 30. Once braking is completed a pair of second springs 32 push back a second rear wheel carrier 30 till it touches a seventh cylinder 31 (FIG. 1). Second spring holders 33 affixed to the inside of frame 1 and a second rear wheel carrier 30 hold a pair of second springs 32. How the braking system works? During skating (FIG. 1) a braking wheel 5 is above the ground and a first rear wheel carrier 7 and a braking wheel carrier 6 are interlocked through their respective parts, a fourth cylinder 9 and a notch 8. A second rear wheel carrier 30 under the body weight of an angle between a second rear wheel carrier 30 and the surface rests against a seventh cylinder 31. To engage the brakes the skater should lift the front wheels 2, 3 of both skates. As result, the braking wheels 5 touches the ground and their carriers 6 start to rotate around an axle 11 counter clockwise till the braking wheel carriers 6 touch fifth cylinders 10 affixed to a frame 1. The said rotation of a braking wheel carrier 6 allows its notch 8 to release a fourth cylinder 9 of a first rear wheel carrier 7. As result, under the body weight a first rear wheel carrier 7 starts to rotate clockwise around a first cylinder 29 while a first rear wheel 4 starts pushing a second rear wheel 26 also clockwise. During the braking action the skating is done on a front wheel 3 and a braking wheel 5 while the body weight is almost entirely on a braking wheel 5 because the mobile wheels 26, 4 get disengages rotatingly idly. Once braking is completed the skates get lifted ( one at the time) off the ground which causes second springs 32, first springs 13 and third springs 19 to push their respective wheel carriers 30,7,6 into their working positions (FIG. 1) while first rear wheel carriers 7 and braking wheel carriers 6 get interlocket again as result.

What is claimed is:

1. An inline skate comprising:

a frame;

a first cylinder affixed to said frame;

a first rear wheel carrier rotatingly mounted on said first cylinder;

a rear wheel rotatingly mounted on said first rear wheel carrier;

first spring holders affixed to said frame and said first rear wheel carrier;

a first pair of springs held by said first spring holders;

an axle fixedly mounted on said frame;

a braking wheel carrier rotatingly mounted on said axle;

a third pair of springs mounted on said axle and resting with one end of each of the second pair of springs against a notch of the cylinder and with another end of each of the second pair of springs against the first spring holders affixed to the braking wheel carrier;

a notch on one end of said braking wheel carrier;

a braking wheel rotatingly mounted on said braking wheel carrier;

a screw regulating the braking force;

a pair of friction cylinders constantly pinching said braking wheel to said screw;

a fourth cylinder affixed to said rear wheel carrier and clutched by said braking wheel carrier notch;

a second cylinder affixed to said frame;

a second rear wheel carrier rotatingly mounted on said second cylinder;

a wheel rotatingly mounted on said second rear wheel carrier;

a second pair of springs and second spring holders identical to the first pair of springs and first spring holders, said second pair of springs being affixed to said frame and said second rear wheel carrier by said second spring holders; and said second pair of springs being affixed to said frame and said second rear wheel carrier by said second spring holders fifth, sixth, and seventh cylinders affixed to said frame limiting counter clockwise rotation of respective said braking wheel carrier, first rear wheel carrier, and second rear wheel carrier.

* * * * *